United States Patent [19]

Geeting

[11] Patent Number: 4,750,571

[45] Date of Patent: Jun. 14, 1988

[54] SCREEN PLACEMENT METHOD AND APPARATUS

[76] Inventor: Marvin D. Geeting, 5524 Cresthill Dr., Fort Wayne, Ind. 46804

[21] Appl. No.: 916,507

[22] Filed: Oct. 8, 1986

[51] Int. Cl.[4] ..... E21B 7/20

[52] U.S. Cl. ..... 175/57; 175/23; 175/171; 175/202; 175/211; 175/258; 175/314

[58] Field of Search ..... 175/57, 257, 258, 314, 175/171, 323, 22, 23, 215, 211, 202; 166/157, 158, 205; 405/253, 254, 242

[56] References Cited

U.S. PATENT DOCUMENTS

| | | | |
|---|---|---|---|
| 443,070 | 12/1890 | Chapman | 175/171 |
| 457,713 | 8/1891 | Hart | 175/314 |
| 804,092 | 11/1905 | Brants | 175/171 |
| 2,197,989 | 4/1940 | Tyler et al. . | |
| 2,979,143 | 4/1961 | Kandle | 175/171 |
| 2,990,896 | 7/1961 | Kandle | 175/171 |
| 3,412,759 | 11/1968 | Potter et al. | 138/89 |
| 3,422,913 | 1/1969 | Young, Jr. | 175/213 |
| 3,499,293 | 3/1970 | Seijikato | 405/241 |
| 3,522,708 | 8/1970 | Firman . | |
| 3,682,261 | 8/1972 | Bird | 175/171 |
| 3,747,697 | 7/1973 | Russell, Jr. | 175/88 |
| 3,833,071 | 9/1974 | Koosman et al. | 175/57 |
| 3,864,923 | 2/1975 | Turzillo | 175/171 |
| 3,965,685 | 6/1976 | D'Amiano | 175/314 |
| 4,113,037 | 9/1978 | Wanner et al. | 175/207 |
| 4,202,416 | 5/1980 | Blaschke et al. | 175/171 |
| 4,363,366 | 12/1982 | Hilty | 175/314 |
| 4,550,787 | 11/1985 | Stefan | 175/88 |

FOREIGN PATENT DOCUMENTS

| | | | |
|---|---|---|---|
| 362867 | 11/1922 | Fed. Rep. of Germany | 175/314 |
| 2924392 | 12/1980 | Fed. Rep. of Germany | 175/257 |
| 9520 | 1/1981 | Japan | 405/254 |
| 44849 | 7/1961 | Poland | 175/171 |

*Primary Examiner*—George A. Suchfield
*Assistant Examiner*—Hoang C. Dang
*Attorney, Agent, or Firm*—George Pappas

[57] ABSTRACT

A screen placement apparatus and system wherein the apparatus includes a motor for providing rotational torque to an auger received within a ground screen and a disposable cutting tip having a cutting diameter equal to or greater than the outer diameter of the screen is connected to the end of the auger. The screen is placed into the ground by simultaneously drilling the hole with the disposable cutting tip, drawing the drill cuttings up through the screen with the auger, and inserting the screen into the hole. The drill cuttings, drawn up through the hole, are discharged through discharge openings. After the desired depth is reached, the auger and motor are longitudinally moved with respect to the screen and cutting tip thereby permanently disconnecting the disposable cutting tip and leaving it within the ground. The auger is, thereafter, retracted from within the ground screen. In an alternate embodiment, a retractable cutting bit is provided for drilling a hole of equal or greater diameter than the screen and, thereafter, being retracted up through the screen along with the auger. A plug is provided for plugging the screen at a desired depth.

12 Claims, 4 Drawing Sheets

SCREEN PLACEMENT METHOD AND APPARATUS

BACKGROUND OF THE INVENTION

This invention pertains to a cost effective method of installing ground screens, either vertically or angularly, to function as dewatering and pumping wells or monitor wells.

In the past, ground screens for soil dewatering and/or monitoring have been placed into the ground by a two-step operation. First, a hole is drilled into the ground with an auger and the soil is removed from therein and, second, the screen is slipped into the hole. This process, however, has proven to be time consuming, cumbersome and often ineffective, because it is a two-step process and, further, the walls of the pre-drilled hole often cave in prior to the ground screen being inserted.

More recently, hollow augers have been utilized to house the ground screen or casing within the auger and after the hole is drilled the auger is backed out of the ground leaving the ground screen therein. A screen placement method and apparatus of this character is disclosed in U.S. Pat. No. 3,833,071. This method of placing ground screens into the ground overcomes the problem of the walls of the hole caving in. However, this method requires that the drilled well hole be substantially larger than the ground screen since the auger, in essence, houses the ground screen or casing. Because a larger hole must be drilled, the method is inefficient in that a greater amount of energy is required to drill the larger hole. Second, the larger hole requirement increases the chances that a rock or other obstacle can be hit by the auger damaging the auger and delaying the process of installation. Further, this method requires a filler material to be utilized around the ground screen or casing after the auger is removed from the hole leaving the casing therein. Naturally, this is both time consuming and costly.

SUMMARY OF THE INVENTION

It is the principle object of the invention to overcome the above-discussed disadvantages associated with earlier screen placement systems and apparatuses. Further, it is an object of the invention to place a ground screen into the ground in a one-step operation, either vertically or angularly by consuming a minimum amount of energy during installation decreasing the chances of hitting an obstacle and, further, eliminating the need for filler to be used around the installed ground screen.

The objects of the invention are obtained, in a preferred form of the invention, through the use of a screen placement apparatus. An auger is connected to a motor and is driven rotationally thereby. The motor is pivotally connected to a boom of a backhoe or skid steer loader. A disconnecting unit is connected to the motor housing and the ground screen is received over the auger and is selectively mounted upon the disconnecting unit. A disposable cutting tip, having an outer cutting diameter equal to or greater than the outer diameter of the ground screen, is attached to the end of the auger with a shear member. The screen is, thereafter, placed into the ground by simultaneously drilling a hole with the disposable cutting tip, drawing the drill cuttings up through the screen with the auger, and inserting the screen into the hole. The drill cuttings drawn upwardly with the auger are discharged through discharge holes located on the disconnecting unit. After the ground screen has reached the required depth, the disconnecting means is utilized to longitudinally displace the auger and motor with respect to the ground screen and cutting tip, thereby shearing the shear bolt and disengaging the auger from the disposable cutting tip. Thereafter, the auger is retracted from the ground screen leaving the ground screen and disposable tip in the ground, and the ground screen is capped at the top in a known and customary manner.

In an alternate embodiment, a retractable cutting bit is utilized whereby, rather than leaving the cutting bit in the ground, it is retracted out from within the screen along with the auger. The retractable cutting bit has a cutting diameter equal to or greater than the outer diameter of the screen, and a retracting diameter smaller than the inside diameter of the screen.

So as to prevent soil and/or liquids from entering the ground screen from its bottom end, a plug is provided for insertion into the ground screen at any level thereof. The plug includes a resilient ring member which has a threaded aperture in which there is disposed a screw having an increasing diameter. After inserting the plug into the ground screen, the screw is turned, causing it to enter the resilient member aperture and, thereby, also forcing the outer perimeter of the resilient member radially outwardly so as to plug the bottom of the ground screen.

In one form thereof, the invention pertains to a screen placement apparatus for simultaneously drilling and placing a cylindrical screen into the ground. A motor provides rotational torque to an auger having a first end and a second end and the auger is adapted to be received within the cylindrical screen. The first end of the auger is connected to the motor and a disposable cutting tip, demountably connectible to the auger and having a cutting diameter at least equal to the outer diameter of the screen, is connected to the second end of the auger. Thus, the cutting tip can cut a hole in the ground while the auger draws up through the screen, the drill cuttings created by the tip. Simultaneously, the screen is placed into the ground and, after the screen is placed into the ground, the tip is disconnected from the auger, and the auger is removed from within the screen.

In one form thereof, the invention pertains to a screen placement apparatus for simultaneously drilling and placing a cylindrical screen into the ground. A motor provides rotational torque to an auger having a first end and a second end and the auger is adapted to be received within the cylindrical screen. The first end of the auger is connected to the motor and a retractable cutting tip is connected to the second end of the auger. The retractable cutting tip has a cutting diameter at least equal to the outer diameter of the screen and a retracting diameter smaller than the inside diameter of the screen.

In one form thereof, the invention is a method of placing a cylindrical screen into the ground. The steps include simultaneously drilling a hole in the ground having a diameter at least equal to the outer diameter of the screen with a disposable cutting tip, drawing drill cuttings up through the screen with an auger having connected at its end the cutting tip, and inserting the screen in the hole. Thereafter, the cutting tip is disengaged from the auger within the hole and the auger is retracted out from within the screen.

In one form thereof, the invention pertains to a method of placing a cylindrical screen into the ground.

The steps include simultaneously drilling a hole in the ground having a diameter at least equal to the diameter of the screen with a retractable cutting bit, drawing drill cuttings up through the screen with an auger having connected at its end the retractable cutting tip, and inserting the screen into the hole. Thereafter, the auger and retractable cutting bit are retracted out from within the hole.

In one form thereof, the invention pertains to a plug for ground screens including a resilient member having an outer perimeter and having a threaded aperture. A screw, having an increasing diameter, is disposed within the threaded aperture whereby the turning of the screw forces the outer perimeter radially outwardly.

BRIEF DESCRIPTION OF THE DRAWINGS

The above-mentioned and other features and objects of this invention and the manner of obtaining them will become more apparent and the invention itself will be better understood by reference to the following description of the embodiments of the invention taken in conjunction with the accompanying drawings wherein.

Corresponding reference characters indicate corresponding parts throughout the several views of the drawings.

DETAILED DESCRIPTION OF THE PREFERRED EMBODIMENT

Figure 1:
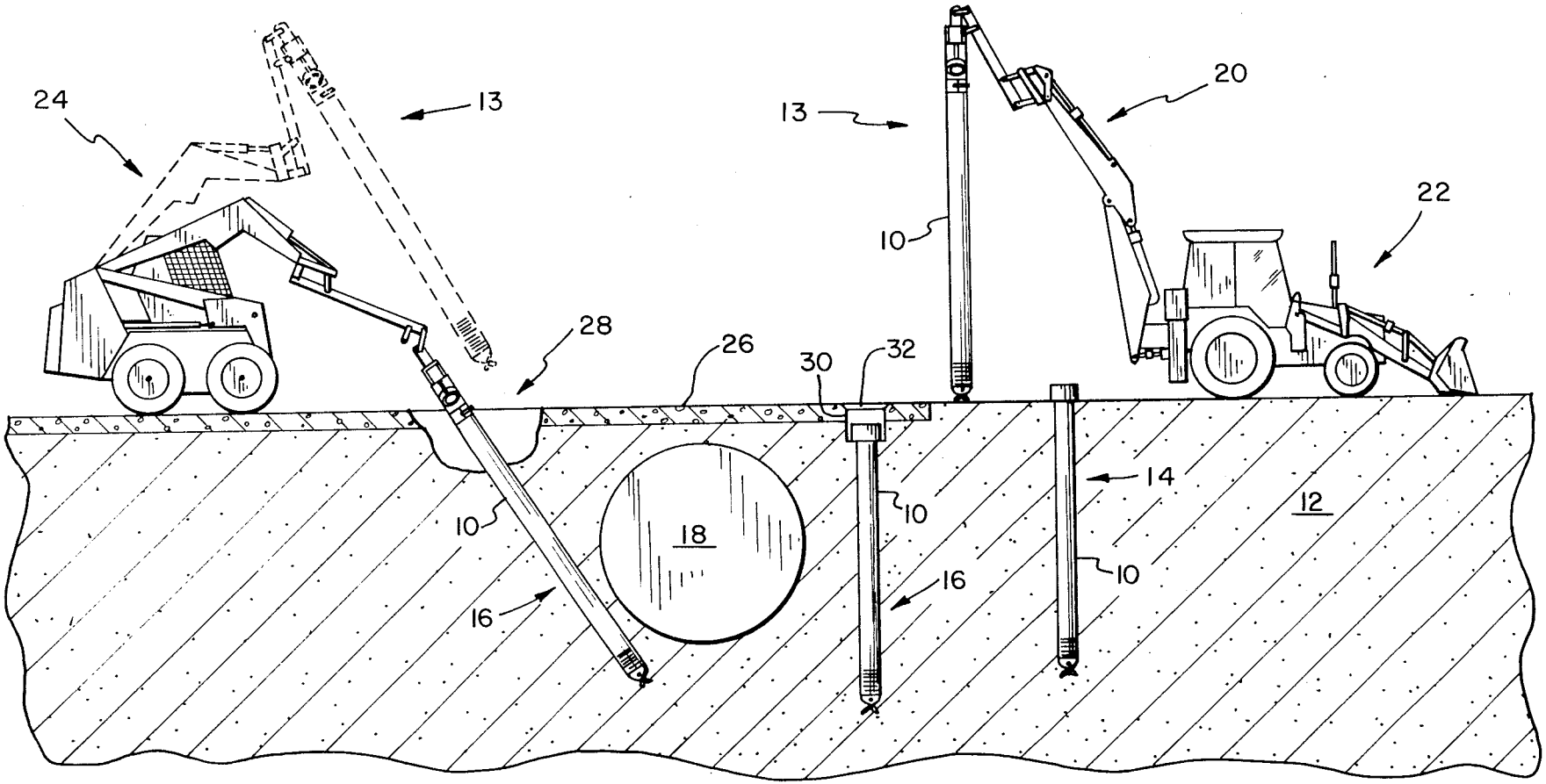
FIG. 1 generally shows the placement of a ground screen according to the present invention through the use of a backhoe or skid loader.

Referring to FIG. 1, the present invention generally relates to the placement of cylindrical ground screens 10 into the ground 12. Two of the many uses of ground screens 10 are for dewatering or pumping wells generally indicated as 14, and monitor wells generally indicated as 16, for monitoring leaks which may occur in underground storage tanks 18.

The screen placement apparatus 13 is mounted on a backhoe boom 20 of backhoe 22, or a skid steer loader 24, or even on a knuckle boom crane (not shown). Ground screens 10 can be put into ground 12 in a substantially vertical position as shown being done through the use of backhoe 22 or angularly as shown being done through the use of skid steer loader 24.

Screens 10 can be placed into uncovered ground as shown being done by backhoe 22. Further, screens 10 can be placed into ground 12 underneath concrete 26 by first breaking up concrete 26 as generally shown at 28. Also, a hole 30 can be drilled in concrete 26, a screen 10 can be placed into ground 12 and a cap 32 used, thereafter, to seal ground screen 10 and hole 30.

Figure 2:
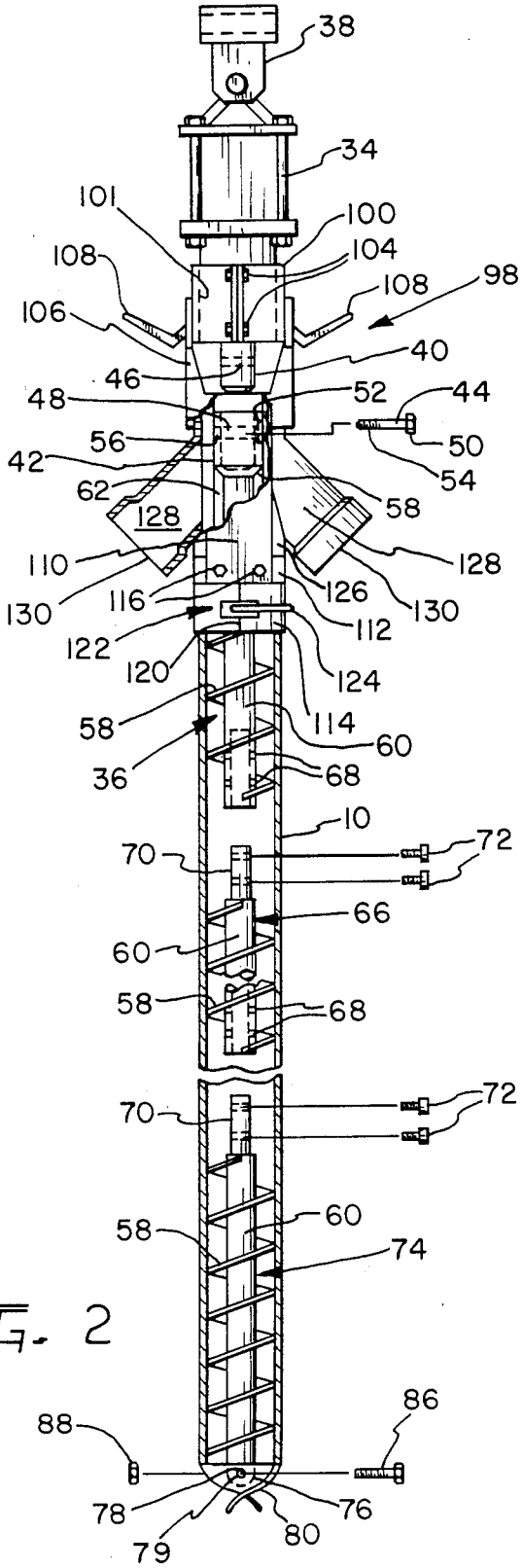
FIG. 2 is a partial cross-sectional elevational view of a preferred embodiment of the screen placement apparatus according to the present invention.
Figure 9:
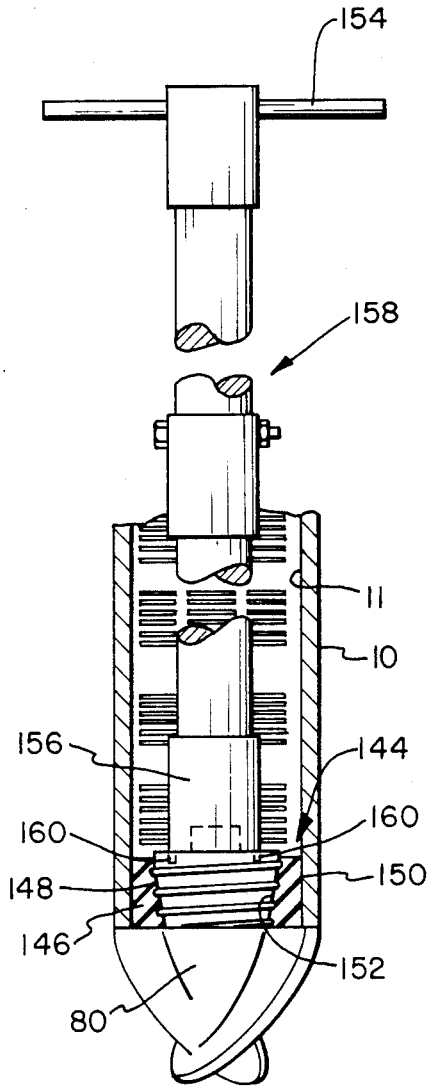
FIG. 9 is a cross-sectional elevational view of a plug for selectively plugging ground screens according to the present invention.
Figure 10:
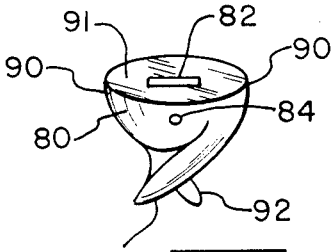
FIG. 10 is a perspective view of the disposable cutting tip shown in FIG. 2.

The screen placement apparatus, as shown in FIG. 2, includes a motor means, or hydraulic motor 34, for providing rotational torque to auger upper section 36. Hydraulic motor 34 is connected to a hydraulic pump (not shown) and is controlled by hydraulic valves located on the respective carrying vehicle such as skid steer loader 24 or backhoe 22. Motor 34 is pivotally connected to swivel weldment 38, which is connected to a respective boom of a carrying vehicle such as backhoe 22 or skid steer loader 24.

Motor 34 has an output shaft 40 upon which there is slidably received collar 42. Collar 42 has a transversely situated hole 48 and motor output shaft 40 also has a transversely situated hole 46. Shaft 40 and collar 42 are rotationally connected by sliding collar 42 over shaft 40 and inserting auger bolt 44 through holes 46 and 48. Head 50 of bolt 44 is received within countersunk bore 52 of collar 42. Bolt 44 is retained in holes 46 and 48 by threading its threaded portion 54 into threaded hole 56.

Figure 6:
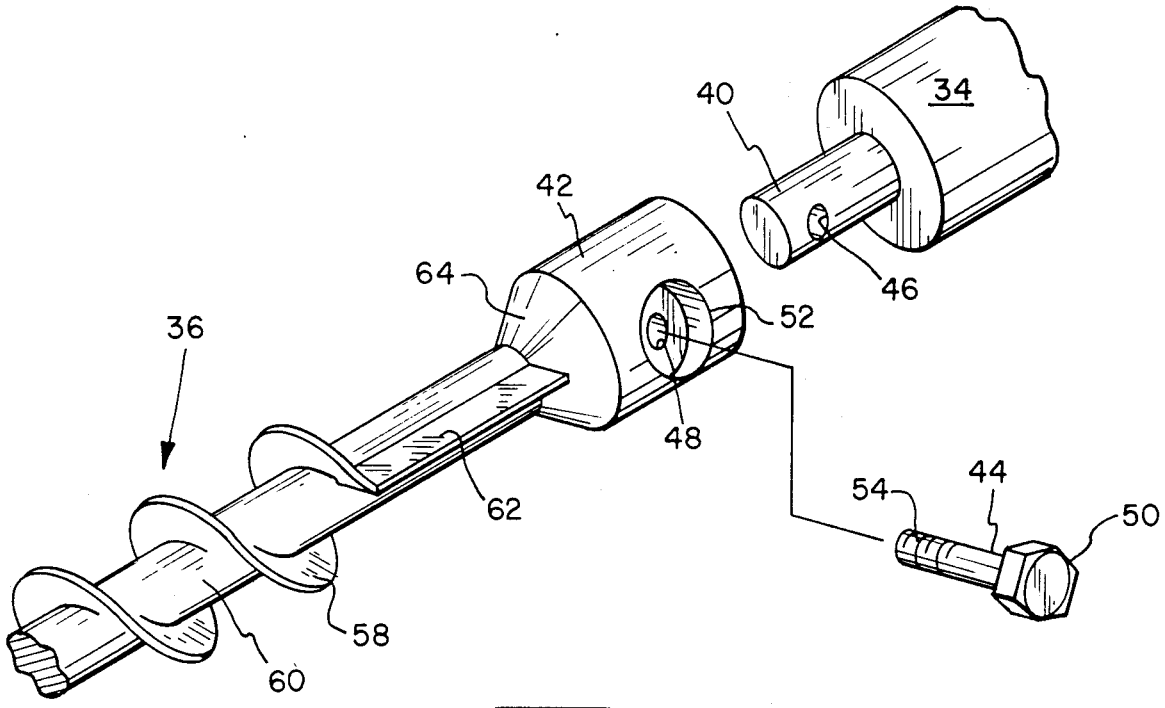
FIG. 6 is a perspective exploded view showing the connection between the auger upper section and the shaft of the motor shown in FIG. 2.

Auger upper section 36 is connected to collar 42 by welding or other suitable means. Auger section 36 is substantially made up of helicoid flighting 58 welded onto auger pipe 60. At the upper portion of auger section 36, as shown in FIG. 6, push bar 62 is welded onto pipe 60 in a substantially radial plane from the axis of pipe 60 and between flighting 58 and frusto-conical surface 64 of collar 42.

As shown in FIG. 2, auger upper section 36 can be extended in length by connecting thereto auger intermediate section 66. Intermediate section 66 is connected to auger 36 by inserting shaft 70 of section 66 into bore 68 of auger 36 and, thereafter, bolting auger 36 and section 66 together through the use of bolts 72 in a known and customary manner.

Lowest auger section 74 is connected to either auger intermediate section 66 or upper section 36 as described above with respect to the connection between auger intermediate section 66 and auger upper section 36. At the lowest end of lowest auger section 74, at the other end of shaft 70, there is connected to pipe 60, by welding or other suitable means, an auger protruding tongue portion 76. Tongue portion 76 has a hole 78 drilled therein substantially perpendicularly and, further, the lower edge 79 of tongue hole 78 is ground to a sharp edge. Tongue portion 76 is substantially flat as shown and is adapted to fit within cavity 82 of disposable cutting tip 80.

Disposable cutting tip 80 is made of hardened steel and is customarily known as a fishtail-type cutting tip. Cutting tip cavity 82 is substantially planar, so as to receive tongue portion 76 and, further, cutting tip 80 has a hole 84 situated substantially perpendicularly to cavity 82. Cutting tip 80 has cutting edges 90 situated radially furthest away from the axis of rotation and, further, has cutting points 92 at its forward end. Cutting tip 80 is connected to lowest auger section 74 by inserting tongue portion 76 into cavity 82 and, thereafter, inserting a shear pin means member or bolt 86 into hole 84 and threading nut 88 onto bolt 86 in a known and customary manner. Bolt 86 and nut 88 are preferably made of nylon. Thus, when cutting tip 80 is pulled longitudinally away from auger section 74, lower cutting edge 79 acts to shear bolt 86 acting as a shear pin and, thereby, allowing cutting tip 80 to break away from auger section 74.

Figure 5:
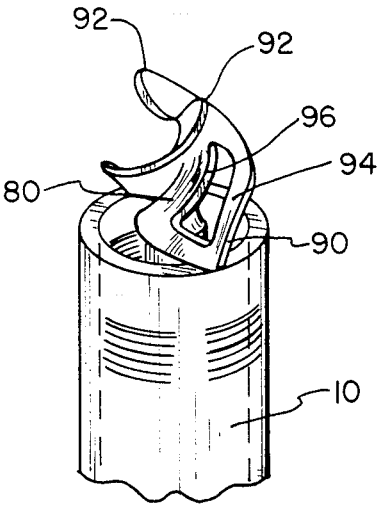
FIG. 5 is a perspective view of another embodiment of the disposal cutting tip shown in FIG. 2.

In an alternative embodiment, as shown in FIG. 5, a grinding means it utilized whereby the drill cuttings, created by cutting tip 80, are ground into finer particles. The grinding means includes grinding hole 96 situated on a cutting tip fin 94. In operation, drill cuttings are partially forced to travel through grinding hole 96 and are, thereby, broken down into smaller finer particles.

Figure 3:
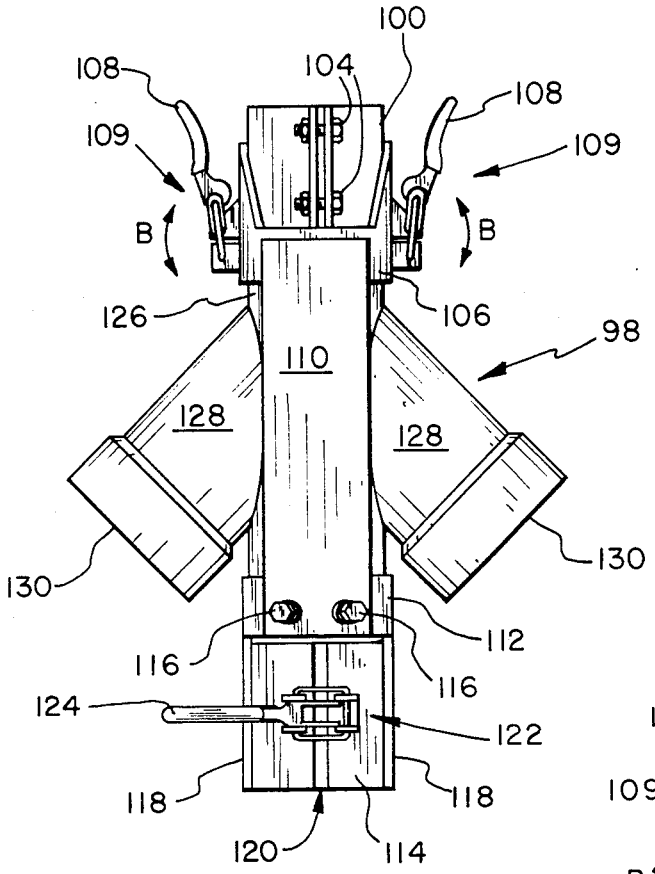
FIG. 3 is a elevational view of a disconnecting unit of the apparatus shown in FIG. 2 with the screen mounting means in the open positions and the disconnecting means in the connected position.
Figure 4:
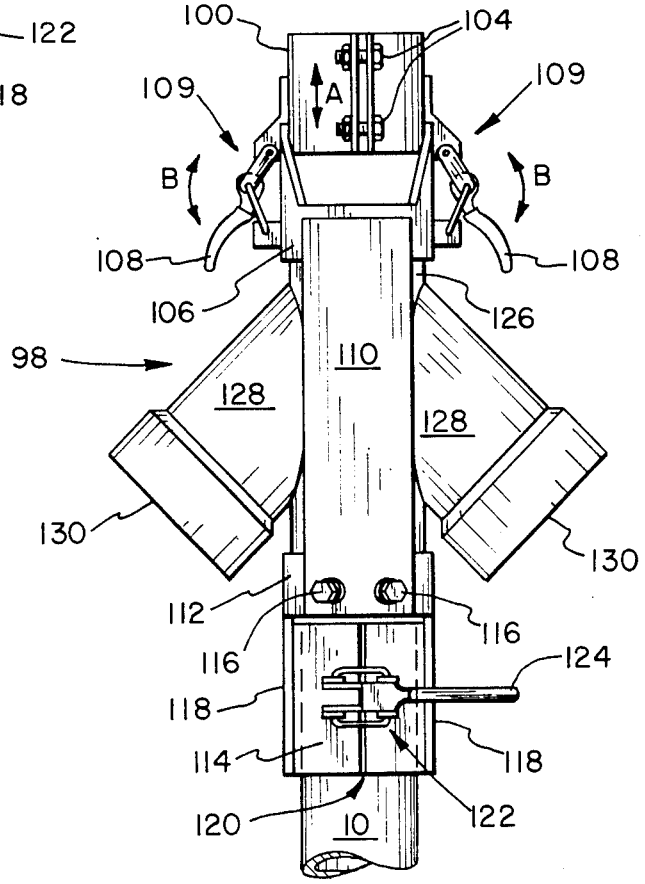
FIG. 4 is an elevational view of a disconnecting unit of the apparatus of FIG. 2 showing the screen mounting means in a closed position and the disconnecting means in the disconnecting position.

The screen placement apparatus includes a disconnecting or breakaway discharge unit generally designated as 98. Disconnecting unit 98 is connected to the housing 102 of motor 34 by tightening upper cylindrical casing 100 onto motor housing 102 through the use of bolts 104. Guiding member 106 is slidingly received over casing 100 and is adapted to slide longitudinally in the direction of arrows A (FIG. 4) with respect to casing 100 and motor 34 by moving upper clamp handles 108 as indicated in FIGS. 3 and 4 by arrows B. Handles 108 and upper toggle clamp assembly 109, along with guiding member 106, substantially make up the disconnecting means for selectively disconnecting cutting tip 80 from auger section 74.

Two semi-cylindrical support bracket 110 are used within disconnecting unit 98 substantially 180 degrees from each other. Each support bracket 110 is connected to guiding member 106 by welding or other suitable means. The lower end of support brackets 110 are connected to lower cylindrical casing 112 having longitudinally extending portions 118 integral therewith. Flexible cylindrical casing 114 is connected within extending portions 118 by welding or other suitable means. Flexible casing 114 has a longitudinal opening 120, the closing and and opening of which decrease and increase the diameter of flexible casing 114. Toggle clamp assembly 122 is connected to flexible casing 114 and is adapted to open and close longitudinal opening 120, thereby selectively increasing and decreasing the diameter of flexible casing 114 b moving handle 124 between the positions shown in FIGS. 3 and 4. As shown in FIGS. 2 and 4, the screen mounting means, including flexible casing 114, clamp assembly 122 and handle 124, are used to selectively mount a ground screen 10 within disconnecting unit 98.

A center pipe 126 is situated between and connected to guiding member 106 and lower cylindrical casing 112. As shown in FIG. 2, upper auger section 36 is coaxially aligned within center pipe 126. Two discharge pipes 128 are situated substantially 180 degrees from each other and are connected to center pipe 126. Discharge pipes 128 each have a discharge opening 130 communicating with the interior of center pipe 126. Discharge pipes 128 further point downwardly and preferably are situated 45 degrees from center pipe 126.

In operation, drill cuttings, which are drawn through ground screen 10 and reach the top of upper auger portion 36, are pushed radially outwardly by push bar 62 and, thereafter, fall out of center pipe 126 through discharge pipes 128 and discharge openings 130.

Figure 7:
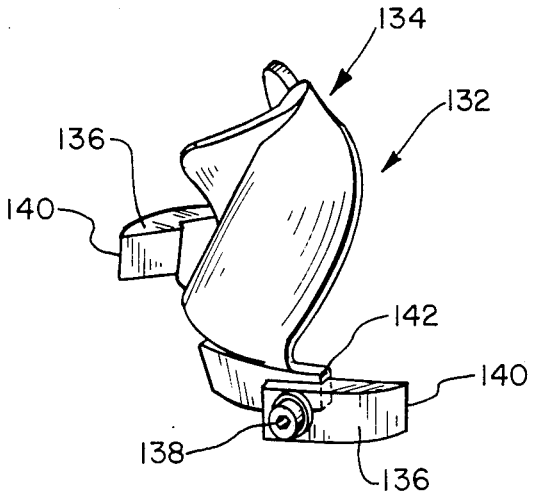
FIG. 7 is a perspective view of a retractable cutting tip in its cutting position.
Figure 8:
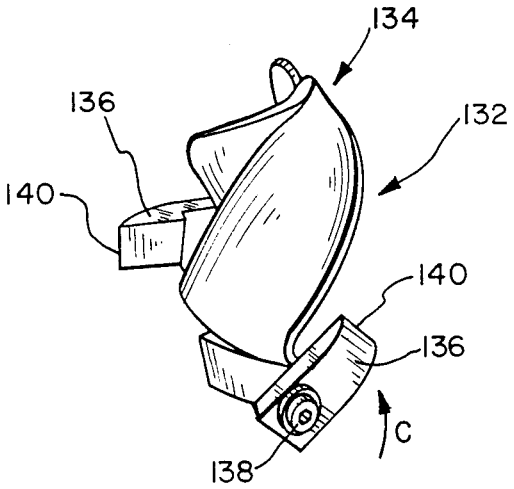
FIG. 8 is a perspective view of the retractable cutting bit shown in FIG. 7 in its retracted position.

In a second embodiment, a retractable cutting bit 132, as shown in FIGS. 7 and 8, is utilized rather than a disposable cutting tip 80. In this embodiment, the disconnecting means whereby guiding member 106, along with the remaining lower portion of the disconnecting unit 98 and screen 10 connected thereto, are moved longitudinally with respect to motor 34 and auger section 36 is not needed.

Retractable bit 132 has a center cutting portion 134 substantially similar to a fishtail cutting tip and, further, has two outer diameter cutting teeth 136 pivotally connected to center cutting portion 134 through the use of screws 138. Teeth 136 have a cutting edge 140. Teeth 136 are in their cutting position when situated substantially radially outwardly from the axis of rotation as shown in FIG. 7 and are in their retracting position when they have been pivoted in a substantially longitudinal position as shown by arrow C in FIG. 8. In essence, when retractable cutting bit 132 is traveling forwardly and downwardly, cutting teeth 136 are pivoted outwardly or, in their radial cutting position as shown in FIG. 7. Teeth 136 are prevented from pivoting further by bearing surface 142. Further, when retractable cutting bit 132 is being retracted, teeth 136 pivot upwardly in the direction of arrow C in their longitudinal position and, thus, the outer diameter of bit 132, in its retracted position, is less than the diameter of the bit in its cutting position as shown in FIG. 7.

The method of operation of the first embodiment utilizing disposable cutting tip 80 is as follows. After first mounting motor 34 onto swivel weldment 38 of a carrying vehicle boom, upper auger section 36 is connected to shaft 40 of motor 34, as described above, through the use of bolt 44. Auger intermediate sections 66, if necessary, may then be connected to auger upper portion 36 as described above. Thereafter, lowest auger section 74 is connected to either a section 66 or 36, depending on the well depth and a ground screen 10 is slipped over the continuous helicoid flighting 58 and is mounted upon disconnect unit 98, as described above, through the use of the disconnect means. Disposable cutting tip 80 is then mounted upon the lowest auger section 74, as shown in FIG. 2, as described above, through the use of bolt 86 and nut 88. It is important that the outer cutting diameter represented by cutting edges 90 of cutting tip 80 is equal to or greater than the outer diameter of ground screen 10. Ground screen 10 is now ready to be placed into ground 12.

Motor 34 is then energized causing all the auger sections, along with disposable cutting tip 80, to rotate therewith. Thus, ground screen 10 is placed into ground 12 by simultaneously drilling the hole in ground 12, drawing the drill cuttings up through the screen with the auger sections and discharging the drill cuttings out of disconnect unit 98 through discharge openings 130.

After the full depth of the ground screen is reached, the disconnecting means, including upper clamp handles 108 and toggle clamp assembly 109, is utilized to break away disposable cutting tip 80. In essence, handles 108 are pushed downwardly as shown in FIG. 4, thereby causing the lower portion of disconnect unit 98, along with ground screen 10 bearing on upper surface 91 of cutting tip 80 and cutting tip 80 itself to be pushed downwardly while motor 34 and the auger sections travel longitudinally upwardly. As discussed above, this shears bolt 86 leaving disposable cutting bit 80 at the bottom of the hole and below ground screen 10. All the auger sections are then fully retracted from within ground screen 10, and the foregoing described method of placing a screen into the ground utilizing a disposable tip may be repeated.

The method of operation of the second embodiment is different from the first embodiment in that retractable cutting bit 132 is utilized rather than a disposable cutting bit 80. Here, the auger sections are first connected to the shaft of motor 34, disconnecting unit 98 is mounted upon motor housing 102, and retractable cutting bit 132 is mounted to the lowest auger section 74, as described above. Then, with cutting teeth 136 in their retracted position, a ground screen 10 is received over retractable cutting bit 132 and helicoid flighting 58. Ground screen 10 is moved upwardly far enough so that cutting teeth 136 can exit from the interior of ground screen 10 and pivot downwardly radially outwardly in their cutting position. Then, ground screen 10 is mounted upon disconnecting unit 98, as described above, and ground screen 10 is ready to be placed into ground 12. It is again important that when cutting teeth 136 are in their cutting position as shown in FIG. 7, that the outer cutting diameter is equal to or greater than the outer diameter of ground screen 10.

Thereafter, ground screen 10 is placed into ground 12 by simultaneously drilling a hole in the ground with retractable cutting bit 132, drawing the soil drill cuttings up through ground screen 10 with the auger sections and discharging the drill cuttings reaching the top of the upper auger section by pushing them out of disconnecting unit 98 through discharge openings 130. Pushbar 62 helps to push the drill cuttings radially outwardly and into discharge pipes 128 as they are moved upwardly by the various auger sections.

Upon reaching the desired well depth, motor 34 is deenergized and ground screen 10 is released from disconnecting unit 98, again, through the use of the screen mounting means as described above. Disconnecting unit 98, along with the various auger sections and retractable bit 132 are then merely moved longitudinally upwardly causing teeth 136 to pivot in their retracting position as shown in FIG. 8 so as to fit within ground screen 10 and allow the various auger sections and retractable cutting bit 132 to be retracted from within ground screen 10. The placement of another ground screen 10 into ground 12 can now be repeated.

It is often desirable to seal the bottom of ground screen 10 to prevent soil particles and/or liquids from entering ground screen 10 through the bottom thereof. Accordingly, plug 144 is provided and includes resilient member 146, made of rubber or other suitable material. Resilient member 146 has an outer perimeter 150 and has a threaded aperture 152 which receives increasing diameter solid core screw 148. It can be seen that by turning screw 148, screw 148 forces itself within aperture 152 thereby forcing resilient member 146 and its outer perimeter 150 radially outwardly so as to make a seal between resilient member 146 and ground screen 10. It should also be noted that the turning of screw 148 also causes the outer perimeter of screw 148 to be forced against the threaded aperture walls creating a seal thereat. Further yet, resilient member 146 is preferably cylindrical-shaped and aperture 152 is substantially coaxially aligned therein.

Plug 144 is inserted with an insertion means including handle 154, plug insertion pipe 158 and drive lug 156. Drive lug 156 has prongs 160, which are received by screw 148 for turning the same by twisting the insertion means.

In operation, plug 144, when screw 148 is not threaded substantially within aperture 152, has an outer perimeter 150 slightly smaller than the inner diameter 11 of ground screen 10. Plug 144 is slipped or received within ground screen 10 after ground screen 10 has been placed in ground 12 and is pushed downwardly into ground screen 10 to a desired depth. Thereafter, screw 148, using the inserting means, by turning handle 154 and forcing screw 148 into aperture 152 forces resilient member 146 radially outwardly. Thus, a frictional seal is created and ground screen 10 is plugged.

While the invention has been described as having specific embodiments, it will be understood that it is capable of further modification. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. A screen placement apparatus for simultaneously drilling and placing a cylindrical screen into the ground, comprising:

an auger having a first end and a second end and having a diameter smaller than the inside diameter of the cylindrical screen, said auger being received within the cylindrical screen;

motor means connected to said first auger end for rotatably driving said auger;

a disposable cutting tip demountably connected to said second auger end having a cutting diameter at least equal to the outer diameter of the cylindrical screen;

wherein said cutting tip is detached from said second auger end by movement of said cutting tip substantially longitudinally away from said auger; and, disconnecting means detachably connected to the cylindrical screen and connected to said motor means, said disconnecting means operative to move the cylindrical screen substantially longitudinally toward said cutting tip and said auger substantially longitudinally away from said cutting tip for providing said substantially longitudinal movement and detaching said cutting tip from said auger.

2. The screen placement apparatus of claim 1 wherein said demountable connection between said tip and auger comprises:

an auger protruding tongue portion connected to said auger second end, said tongue portion having a hole therein;

a cavity in said cutting tip for receiving said tongue portion;

a cutting tip hole through said cutting tip communicating with said cavity and substantially aligned with said tongue portion hole when said tongue is received within said cavity; and, a shear member received through said cutting tip hole and tongue hole.

3. The screen placement apparatus of claim 2 wherein said shear member is a nylon bolt.

4. The screen placement apparatus of claim 1, wherein said disconnecting means is part of a disconnecting unit mounted upon said motor means, said disconnecting unit including:

screen mounting means for selectively mounting the screen upon said disconnecting unit; and, a discharge opening for discharging drill cuttings drawn through the screen.

5. The screen placement apparatus of claim 1 wherein said disposable cutting tip includes grinding means for grinding the drill cuttings prior to their entering the screen.

6. A method of placing a cylindrical screen into the ground comprising the steps of:

simultaneously drilling a hole in the ground having a diameter at least equal to the outer diameter of the screen with a disposable cutting tip, drawing drill cuttings up through the screen with an auger having detachably connected at its end thereof said tip and, inserting the screen in the hole;

operating a disconnecting means to force said screen downwardly and move said auger upwardly moving said auger longitudinally away from said tip, shearing a shearing member and, disengaging said tip from said auger end within the hole; and, retracting said auger out from within the screen.

7. The method of claim 6 further comprising the step of discharging the drill cuttings out of the screen through a discharge hole located in a disconnecting unit to which the screen is selectively connected substantially near its top end.

8. The method of claim 6 further comprising the steps of:

inserting in the cylindrical screen a resilient member having disposed substantially axially therein a screw with an increasing diameter; and turning said screw and thereby forcing said resilient member radially outwardly thereby plugging the screen.

9. A screen placement apparatus for simultaneously drilling and placing a cylindrical screen into the ground, comprising:

an auger having a first end and a second end and having a diameter smaller than the inside diameter of the cylindrical screen, said auger being received within the cylindrical screen;

motor means connected to said first auger end for rotatably driving said auger;

a disposable cutting tip demountably connected to said second auger end having a cutting diameter at least equal to the outer diameter of the cylindrical screen;

wherein said demountable connection between said auger and said cutting tip further comprises shear means for holding together said auger and said cutting tip and for shearing and detaching said tip from said auger by movement of said tip substantially longitudinally away from said auger; and, disconnecting means detachably connected to the cylindrical screen and connected to said motor means, said disconnecting means operative to move the cylindrical screen substantially longitudinally toward said cutting tip and said auger substantially longitudinally away from said cutting tip for providing said substantially longitudinal movement and detaching said cutting tip from said auger.

10. The screen placement apparatus of claim 9 wherein said demountable connection between said cutting tip and said auger comprises:

an auger protruding tongue portion connected to said auger second end, said tongue portion having a hole therein;

a cavity in said cutting tip for receiving said tongue portion;

a cutting tip hole through said cutting tip communicating with said cavity and substantially aligned with said tongue portion hole when said tongue is received within said cavity; and, wherein said shear means is received through said cutting tip hole and tongue hole.

11. The screen placement apparatus of claim 10 wherein said shear means is a nylon bolt.

12. The screen placement apparatus of claim 9 wherein said disconnecting means is part of a disconnecting unit mounted upon said motor means, said disconnecting unit including:

screen mounting means for selectively mounting the screen upon said disconnecting unit; and, a discharge opening for discharging drill cuttings drawn through the screen.

* * * * *

UNITED STATES PATENT AND TRADEMARK OFFICE

CERTIFICATE OF CORRECTION

PATENT NO. : 4,750,571

DATED : June 14, 1988

INVENTOR(S) : Marvin D. Geeting

It is certified that error appears in the above-identified patent and that said Letters Patent is hereby corrected as shown below:

Col. 3, line 25, insert --steer-- after "skid"; and,

Col. 5, line 43, change "114b" to --114 by--.

Signed and Sealed this

Eighth Day of November, 1988

*Attest:*

DONALD J. QUIGG

*Attesting Officer*

*Commissioner of Patents and Trademarks*